US007024130B2

(12) United States Patent
Serizawa et al.

(10) Patent No.: US 7,024,130 B2
(45) Date of Patent: Apr. 4, 2006

(54) ROTATING BODY, COOLING APPARATUS THAT COOLS A ROTATING BODY, AND IMAGE FORMING APPARATUS THAT USES A ROTATING BODY AND A COOLING APPARATUS

(75) Inventors: Takashi Serizawa, Tokyo (JP); Hiroaki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/423,784

(22) Filed: Apr. 25, 2003

(65) Prior Publication Data

US 2003/0210922 A1 Nov. 13, 2003

(30) Foreign Application Priority Data

May 7, 2002 (JP) ..... 2002-131821

(51) Int. Cl.
*G03G 15/00* (2006.01)

(52) U.S. Cl. ..... 399/96; 399/92

(58) Field of Classification Search ..... 219/216; 399/92, 93, 94, 96, 97, 98, 328, 330
See application file for complete search history.

(56) References Cited

U.S. PATENT DOCUMENTS 4,585,319 A * 4/1986 Okamoto et al. ..... 399/96
5,307,133 A * 4/1994 Koshimizu et al. ..... 399/92
5,788,382 A * 8/1998 Egbert et al. ..... 400/118.3

* cited by examiner

*Primary Examiner*—Hoang Ngo
(74) *Attorney, Agent, or Firm*—Akin Gump Strauss Hauer & Feld, LLP

(57) ABSTRACT

A cooling apparatus cools a rotating body in an image forming apparatus. The cooling apparatus includes a hollow cylindrical rotating body rotating about a longitudinal axis, a cooling section, and a drive source. The cooling section is located outside of the rotating body. The cooling section rotates when the rotating body rotates, and sends air to the rotating body so that the rotating body is cooled by convection of air. The drive source operatively drives the rotating body and the cooling section. The rotating body is provided with a first air-propelling member that takes air into an inner space of the rotating body and a second air-propelling member provided that discharges air from the inner space. The air-propelling member may be a vane that describes a spiral and generally extends along the longitudinal axis.

10 Claims, 6 Drawing Sheets

ROTATING BODY, COOLING APPARATUS THAT COOLS A ROTATING BODY, AND IMAGE FORMING APPARATUS THAT USES A ROTATING BODY AND A COOLING APPARATUS

BACKGROUND OF THE INVENTION

1. Field of the Invention

The present invention relates to a rotating body, a cooling apparatus that cools the rotating body, and an image forming apparatus, and more particularly relates to a cooling apparatus that cools a photoconductive drum for use in an image forming apparatus such as an electrophotographic printer and a copying machine.

2. Description of the Related Art

A photoconductive drum is employed in a conventional image-forming apparatus such as an electrophotographic printer and a copying machine. The photoconductive drum is in the shape of a cylinder that rotates about a longitudinal axis.

A charging roller and a developing roller rotate in contact with the surface of the photoconductive drum. The charging roller charges the surface of the photoconductive drum uniformly to a predetermined potential. A recording head illuminates the charged surface of the photoconductive drum in accordance with print data to form an electrostatic latent image on the surface. The developing roller applies toner to the electrostatic latent image to develop the latent image into a toner image.

When the photoconductive drum rotates, heat is generated due to the frictional engagement between the photoconductive drum and the charging roller and the frictional engagement between the photoconductive drum and the developing roller. When the surface temperature of the photoconductive drum exceeds 50° C. due to the heat generated, the potential on the photoconductive drum charged by the charging roller will decrease so that the residual potential of the illuminated surface of the drum increases. High residual potential fails to form an image with high contrast.

SUMMARY OF THE INVENTION

An object of the present invention is to provide an image-forming apparatus employing a photoconductive drum that is capable of forming an image with high contrast.

Another object of the invention is to provide a photoconductive drum that forcibly dissipate the heat generated due to the fact that the photoconductive drum rotates in contact with the charging roller, developing roller, and transfer roller.

A cooling apparatus cools a rotating body. The cooling apparatus includes a hollow cylindrical rotating body rotating about a longitudinal axis, a cooling section that operatively rotates together with the rotating body, and a drive source that drives the rotating body and the cooling section. The cooling section sends air toward the rotating body so that the rotating body cools by convection of air.

The cooling section is located outside of the rotating body.

The rotating body includes at least one air-propelling member located in the rotating body.

The air-propelling member may be integral with the rotating body.

The cooling section rotates at a speed different from the rotating body.

The rotating body may be a photoconductive body.

The rotating body may be a photoconductive drum disposed in an image forming apparatus.

The cooling section may be in the shape of a propeller.

The air-propelling member takes air into the rotating body.

The air-propelling member discharges air from the rotating body.

The rotating body is provided with a first air-propelling member that takes air into the rotating body and a second air-propelling member provided that discharges air from the rotating body.

The air-propelling member may be a vane formed in one piece with the rotating body.

The air-propelling member is a vane that describes a spiral and generally extends along the longitudinal axis.

The air-propelling member is one of a plurality of vanes.

An image forming apparatus incorporating the aforementioned cooling apparatus in which the cooling section sends air The image forming apparatus of the aforementioned configuration includes an air outlet through which air sent by the cooling section is discharged from the image forming apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described in detail with reference to the accompanying drawings.

First Embodiment

Figure 1:
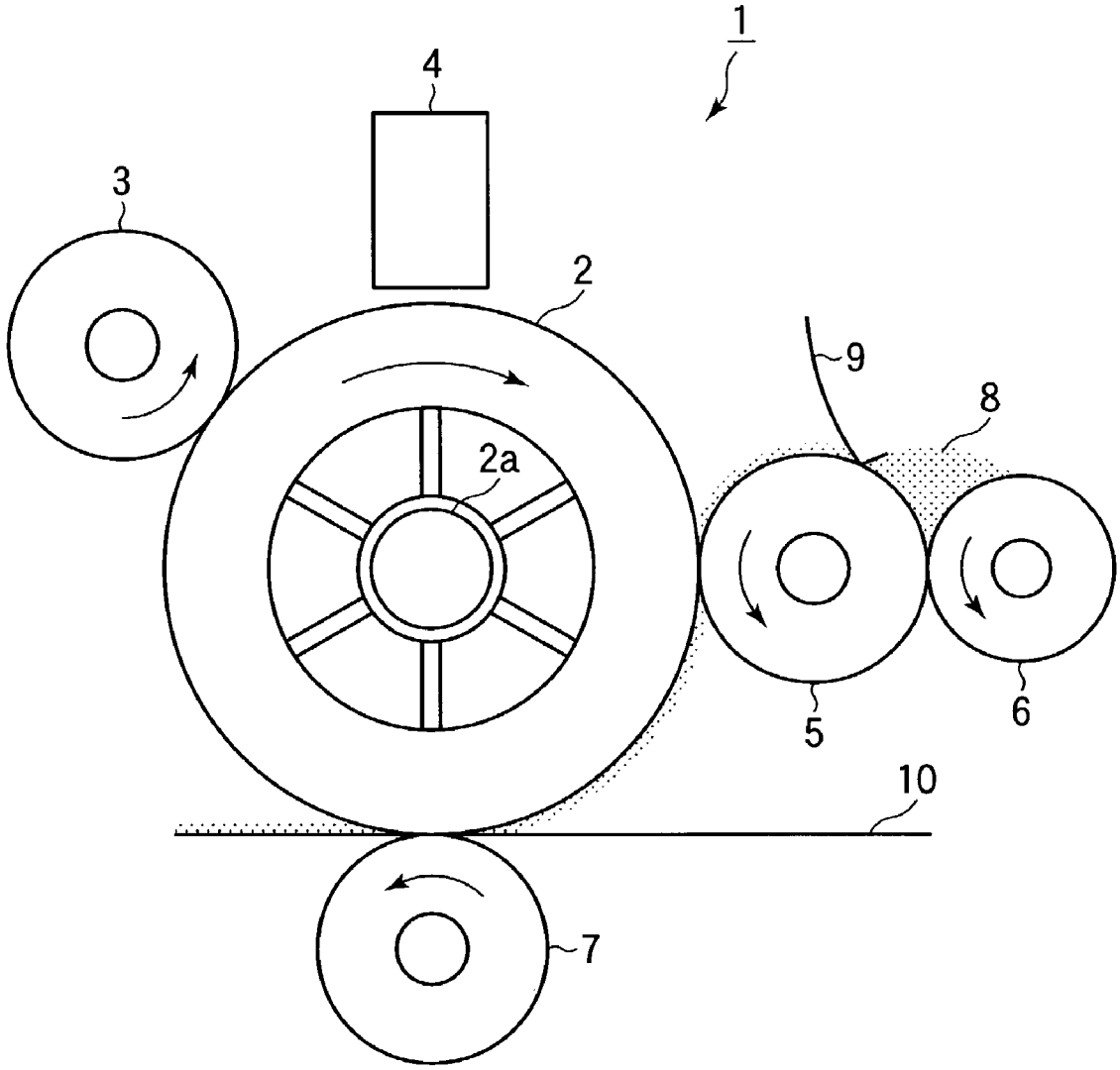
FIG. 1 illuminates an image forming apparatus according to a first embodiment.

FIG. 1 illuminates an image-forming apparatus according to a first embodiment.

The image-forming apparatus 1 includes a photoconductive drum 2, a charging roller 3, a recording head 4, a developing roller 5, a toner supplying roller 6, and a transfer roller 7. The photoconductive drum 2 is rotatably supported on a shaft 2*a* and rotates relative to the shaft 2*a*. The charging roller 3, recording head 4, developing roller 5, toner supplying roller 6, and transfer roller 7 rotates in contact with the photoconductive drum 2.

The charging roller 3, developing roller 5, and transfer roller 7 are in pressure contact with the surface of the photoconductive drum 2. The toner-supplying roller 6 is in pressure contact with the developing roller 5.

A blade 9 is in pressure contact with the developing roller 5, thereby triboelectrically charging toner 8 which is to be supplied to the toner-supplying roller 6 as well as forming a thin layer of the toner 8.

The photoconductive drum 2 is coupled to the charging roller 3, developing roller 5, toner supplying roller 6, and transfer roller 7 by means of a gear train, not shown, so that a single drive source drives the respective rotating bodies to rotate in directions shown by arrows.

The charging roller 3 charges the photoconductive drum 2 uniformly to a predetermined potential, and the recording head 4 illuminates the charged surface in accordance with print data to form an electrostatic latent image. The developing roller 5 applies the charged toner 8 to the electrostatic latent image, thereby developing the latent image into a toner image.

At a transfer point defined between the photoconductive drum 2 and the transfer roller 7, the toner image is transferred onto print paper 10 that is charged to a polarity opposite to the charged toner 8.

Figure 2:
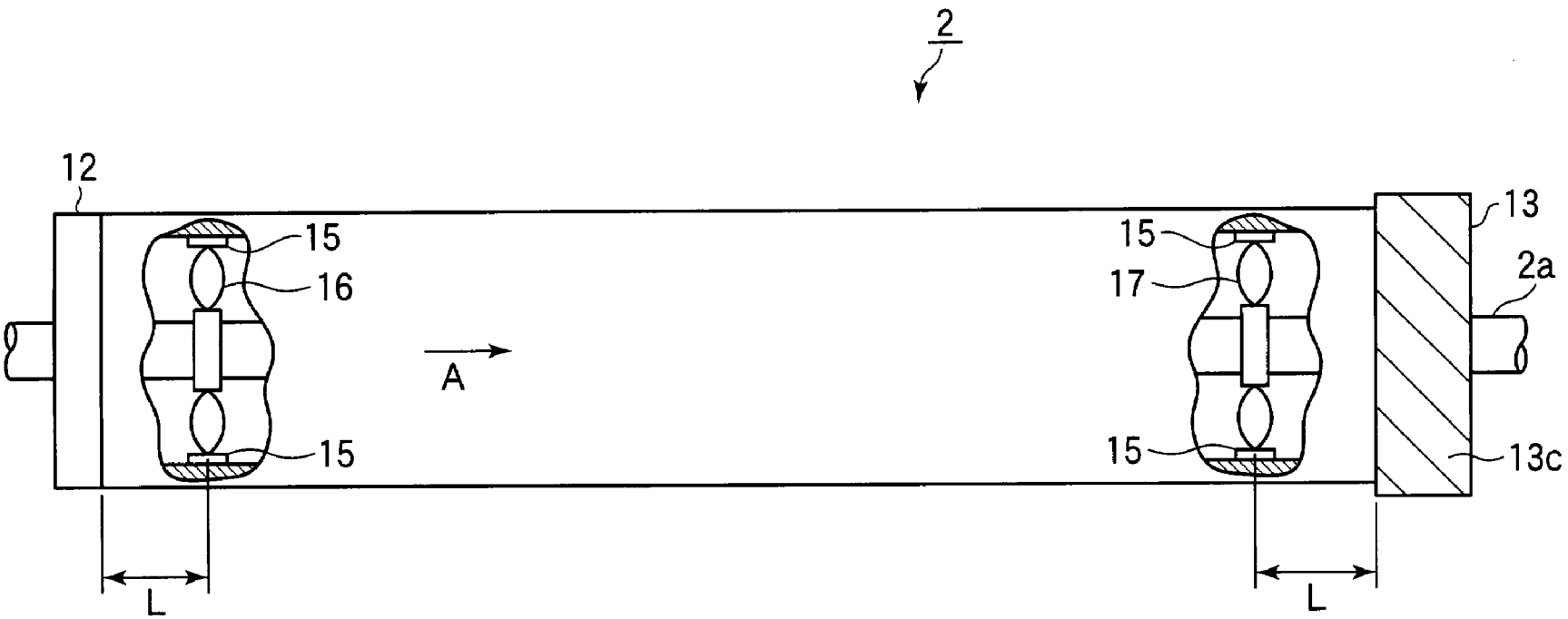
FIG. 2 illustrates the detail of the photoconductive drum in the image forming apparatus in FIG. 1.

FIG. 2 illustrates the detail of the photoconductive drum in the image-forming apparatus in FIG. 1.

Figure 3A:
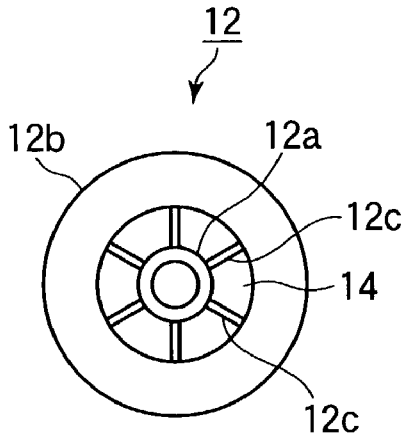
FIGS. 3A and 3B are side views of the photoconductive drum.
Figure 3B:
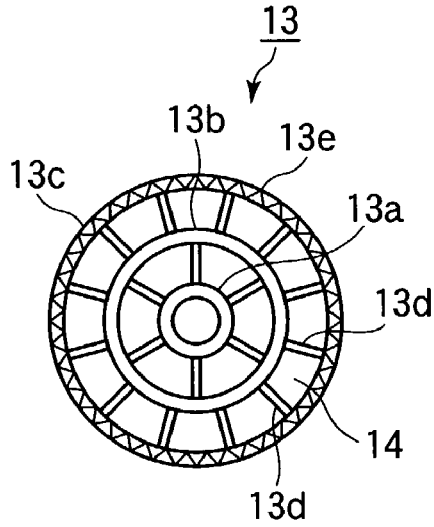

FIGS. 3A and 3B are side views of the photoconductive drum.

Figure 4:
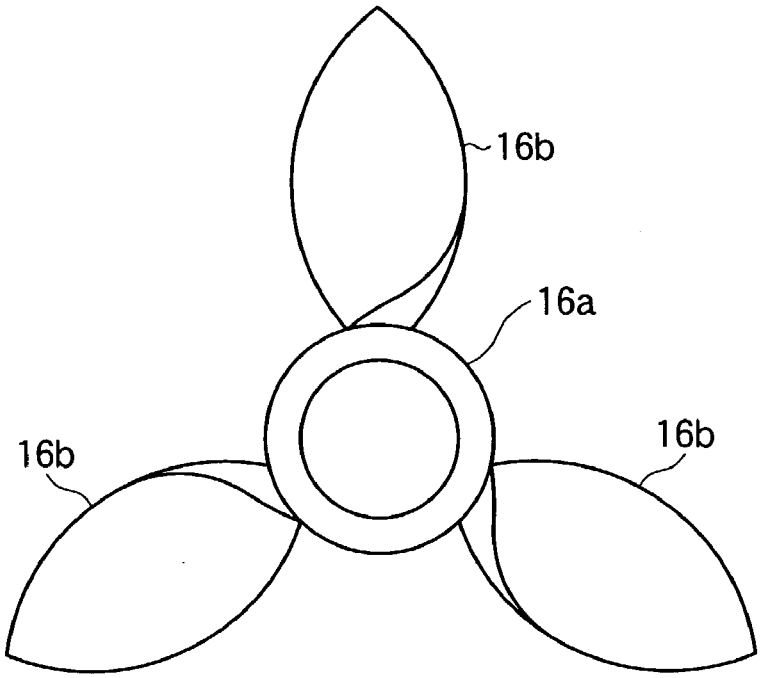
FIG. 4 illustrates a fan in detail.

FIG. 4 illustrates a fan in detail.

The photoconductive drum 2 has a shaft 2*a* that extends through the side walls 12 and 13 provided at longitudinal ends of a cylindrical electrically conductive base, not shown, covered with a photoconductive material.

Referring to FIG. 3A, the side wall 12 has a hub 12*a* rotatable with respect to the shaft 2*a*. A plurality of vanes 12*c* are formed between the hub 12*a* and a rim 12*b*. The vanes 12*c* define air paths 14 therebetween. Ribs may be formed in place of the vanes, being in such a shape that the ribs propel air to move.

There are a plurality of vanes 13*d* provided between rim 13*b* and 13*c* and between the hub 13*a* and the rim 13*b*. The rim 13*c* has a gear 13*e* formed in its outer surface, the gear 13*e* being rotatable together with the photoconductive drum 2 about the shaft 2*a*.

As shown in FIG. 4, fans 16 and 17 and hubs 16*a* and 17*a* are rotatable on the shaft 2*a*. As shown in FIG. 1, the tips of the fans 16 and 17 are fixed to the inner surface of the photoconductive drum 2 by an adhesive 15. Each of the fans 16 and 17 has three to eight blades and is located within 50 mm from the side walls 12 and 13.

Figure 5:
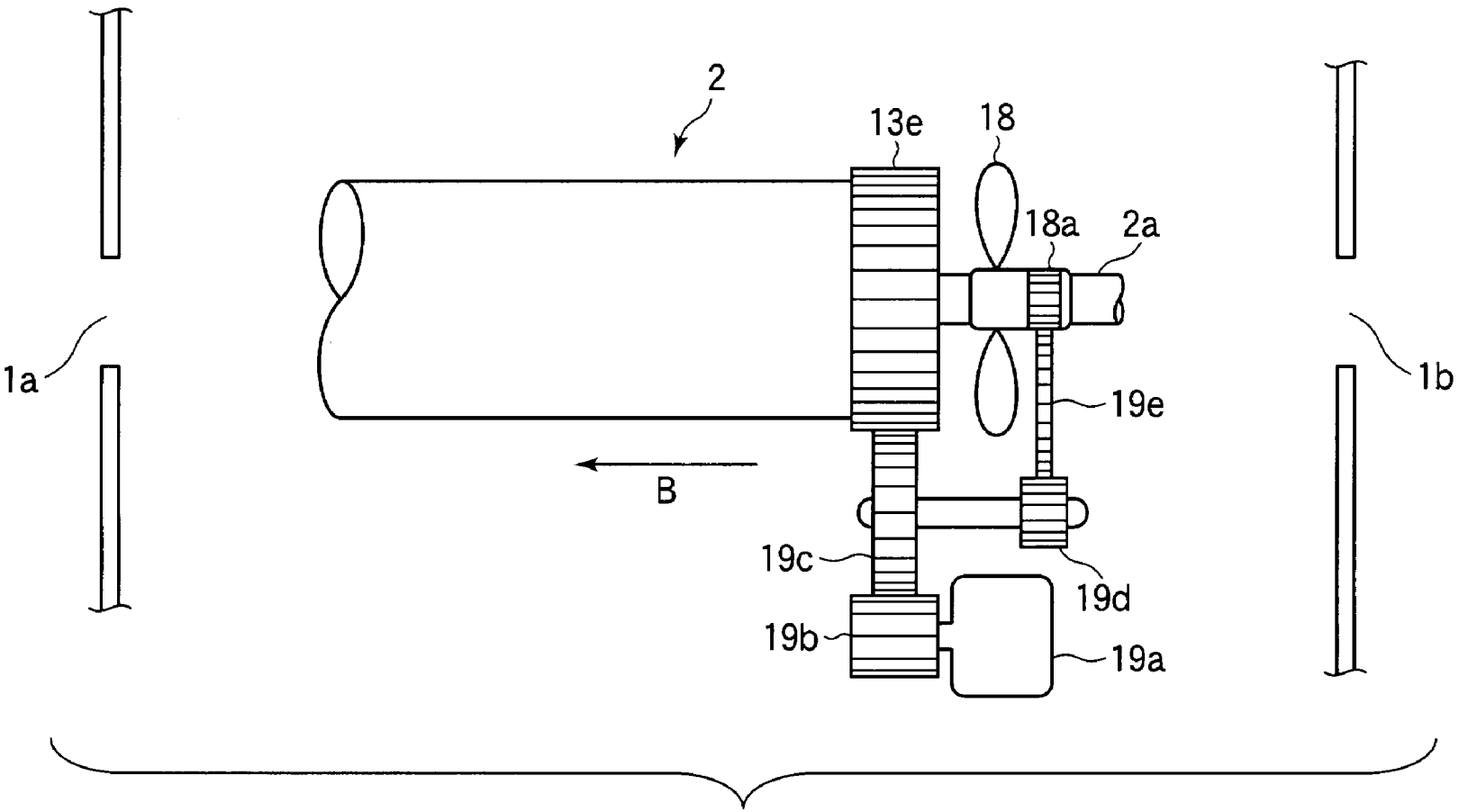
FIG. 5 illustrates the positional relation between an outer fan and the photoconductive drum.

FIG. 5 illustrates an outer fan that is operatively coupled to the photoconductive drum 2. The photoconductive drum 2 and outer fan 18 are rotatably supported on the shaft 2*a* and rotate relative to the shaft 2*a*. The photoconductive drum 2 receives a drive force from a drive source 19*a* through gears 19*b*, 19*c*, and a gear formed in the side wall 13. The outer fan 18 receives a drive force through gears 19*a*, 19*c*, 19*d*, 19*e*, and 18*a*. The gears 19*a*, 19*c*, 19*d*, 19*e*, and 18*a* provides a higher gear ratio than the gears 19*b*, 19*c*, and 13*e*, so that the outer fan 18 rotates at a higher speed than the photoconductive drum 2. Alternatively, the gears 19*a*, 19*c*, 19*d*, 19*e*, and 18*a* may provide the higher gear ratio as the gears 19*a*, 19*c*, and a gear formed in the side wall 13 of the photoconductive drum 2, so that the outer fan 18 rotates at the same speed as the photoconductive drum 2. Still alternatively, the outer fan 18 may be fixedly mounted on the shaft 2*a* so that the outer fan 18 can rotate at the same speed as the photoconductive drum 2. The drive force takes the form of, for example, an electric motor. The outer fan 18 sends the air surrounding the photoconductive drum 2 to the photoconductive drum 2, thereby cooling down the photoconductive drum 2 by convection of air. The outer fan 18 also sends the air in a direction shown by arrow B into the inner space of the hollow cylindrical photoconductive drum 2 so that the photoconductive drum 2 is more efficiently cooled.

The image forming apparatus 1 is provided with an air outlet 1*a*, which is located downstream of the flow of air. The air blown by the outer fan 18 is exhausted from the apparatus 1 through the air outlet 1*a*. The image forming apparatus 1 is also provided with an air inlet 1*b*, which is located upstream of the flow of air, i.e., behind the outer fan 18.

The operation of the photoconductive drum 2 according to the first embodiment will be described.

When the photoconductive drum 2 rotates during printing, the fans 16 and 17 rotate together with the photoconductive drum 2 about the shaft 2*a*. The fans 16 and 17 rotate to propel the air inside of the conductive drum 2 in a direction shown by arrow A. As a result, the air is introduced from the outside into the photoconductive drum 2 through the air inlet 14 formed in the side wall 12 and the inside air is discharged through the air outlet 14 formed in the side wall 13.

Due to the fact that the charging roller 3, developing roller 5, and transfer roller 6 are in pressure contact with the photoconductive drum 2, friction heat is generated and stored in the photoconductive core 2. The heat in the photoconductive drum 2 is transferred to the air inside the photoconductive drum 2. The fan 16 constantly sucks air into the photoconductive core 2 and the fan 17 constantly discharges air from the photoconductive core 2, thereby preventing the surface temperature of the photoconductive drum 2 from increasing.

A fan, not show, in the printer ventilates the air around the photoconductive drum.

Thus, the charge on the photoconductive drum will not be deteriorated and the residual potential of an area illuminated by the recording head is maintained low, so that the photoconductive drum ensures desirable electrical properties required for images of high contrast.

Second Embodiment

Figure 6:
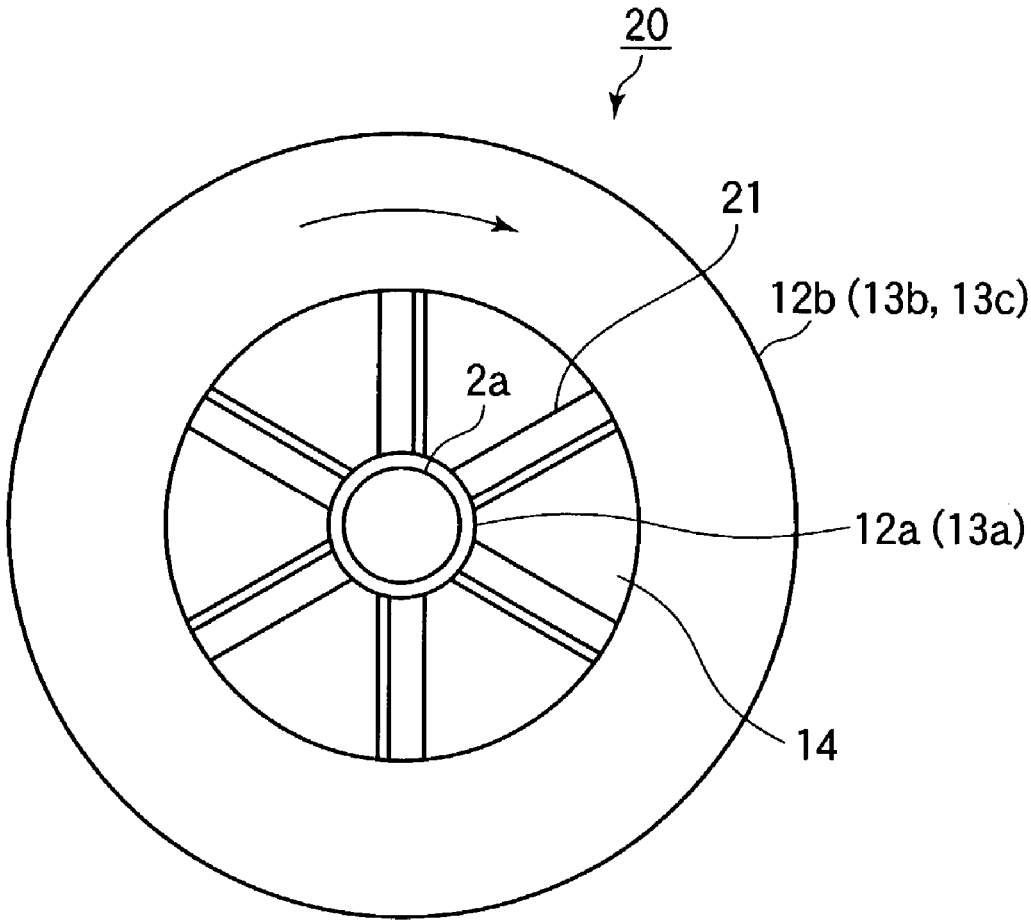
FIG. 6 is a side view of a photoconductive drum according to a second embodiment.

FIG. 6 is a side view of a photoconductive drum according to a second embodiment.

A photoconductive drum 20 according to the second embodiment differs from the photoconductive drum 2 according to the first embodiment in the shape of the path 14 formed in the side wall 13 and 14. FIG. 6 illustrates only the side wall 12.

The vanes 21 of the side walls 12 and 13 are twisted such that the vanes 21 lie in planes oblique to the shaft 2*a* that extends through the hubs 12*a* and 13*a*. Therefore, the air paths 14 at the side wall 12 are twisted in such a direction as to introduce the air into the photoconductive drum 2. The air path 14 at the side wall 13 are twisted in such a direction as to discharge the air from the photoconductive drum 2.

The vanes 21 are shaped close to the fans 16 and 17 and serve as a fan. Thus, in the second embodiment, the fan 16 and 17 may be omitted.

The second embodiment operates in the same way as the first embodiment.

Because the vanes serve as a fan that propels the air, the photoconductive drum 2 according to the second embodiment can be simpler than that according to the first embodiment.

Third Embodiment

Figure 7:
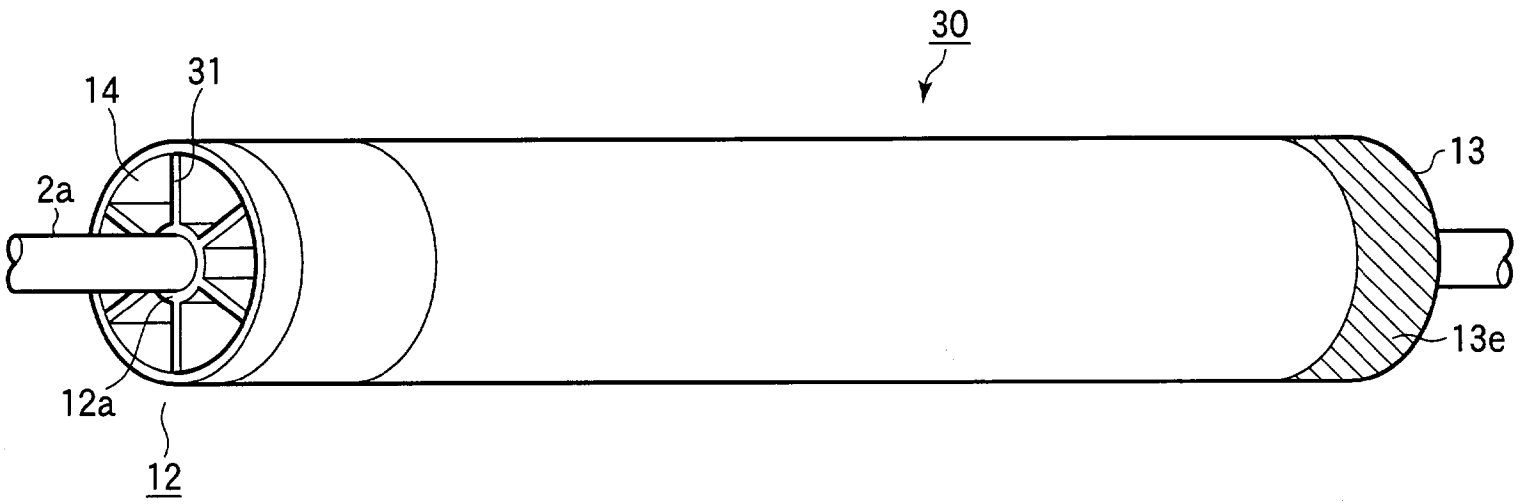
FIG. 7 illustrates a photoconductive drum according to a third embodiment.

FIG. 7 illustrates a photoconductive drum according to a third embodiment.

Figure 8:
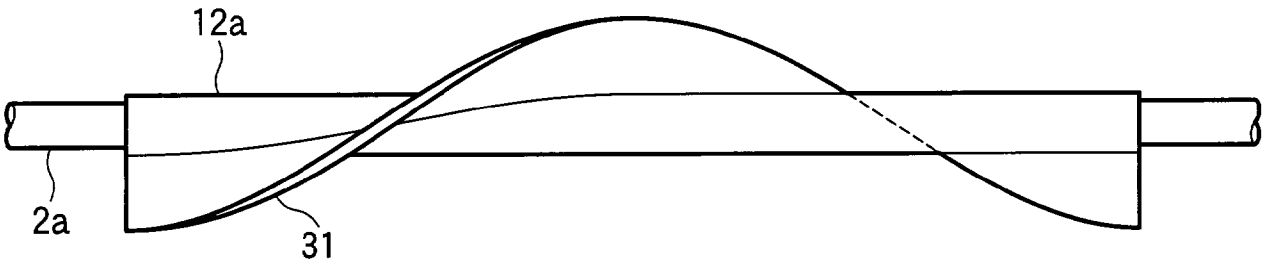
FIG. 8 illustrates one of six vanes formed in the photoconductive drum.

FIG. 8 illustrates one of six vanes formed in the photoconductive drum.

A photoconductive drum 30 according to the third embodiment differs from the photoconductive drum 2 according to the second embodiment in that vanes 31 are formed to describe a spiral along the hub 12*a* of the photoconductive drum 30. Each of the vanes 31 makes substantially one complete spiral around the hub 12*a*.

Thus, spiraled air paths 32 are defined between adjacent vanes 31, guiding the air introduced through the air inlet 14 to flow into the air paths 32 and exit from the air paths 32. In other words, the entire photoconductive drum 2 plays a role of a propeller.

Each vane 31 has one end in one piece with the side wall 12 and the other end fixed by means of the adhesive 15.

The photoconductive drum 2 according to the third embodiment operates in the same way as the second embodiment and therefore the description thereof is omitted.

The photoconductive drum according to the third embodiment is excellent in cooling effect as compared to the first and second embodiments.

Ribs may be formed in place of the vanes, being in such a shape that the ribs propel air to move.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A cooling apparatus that cools a rotating body, comprising:

a hollow cylindrical rotating body that rotates about a longitudinal shaft;

at least one propeller-shaped vane formed in an inner space of said rotating body, said at least one propeller-shaped vane lying in a spiral plane about the longitudinal shaft and being in one piece with the longitudinal shaft and said rotating body, wherein said at least one vane causes air to enter the inner space through one end of said rotating body and exit the inner space through another end of said rotating body so that the rotating body is cooled by convection of air; and a drive source that drives said rotating body in rotation.

2. The cooling apparatus according to claim 1, wherein said at least one vane is one of a plurality of vanes.

3. The cooling apparatus according to claim 1, wherein said at least one vane is formed near a longitudinal end of said rotating body.

4. The cooling apparatus according to claim 1, wherein said rotating body is a photoconductive drum.

5. The cooling apparatus according to claim 4, wherein the photoconductive drum is disposed in an image forming apparatus.

6. The cooling apparatus according to claim 1, wherein said at least one vane is one of a plurality of vanes, wherein said rotating body is provided with a first set of vanes at one longitudinal end portion of the inner space and a second set of vanes at another longitudinal end portion of the inner space.

7. The cooling apparatus according to claim 1, wherein said at least one propeller-shaped vane is in the shape to describe at least one complete spiral and extends on the longitudinal shaft over substantially a full length of said inner space.

8. The cooling apparatus according to claim 7, wherein said at least one vane is one of a plurality of vanes.

9. An image forming apparatus that incorporates a cooling apparatus according to claim 5.

10. The cooling apparatus according to claim 9, including an air outlet through which air sent by said at least one vane is discharged from the image forming apparatus.

* * * * *